US008196783B2

(12) United States Patent
Krzecki

(10) Patent No.: US 8,196,783 B2
(45) Date of Patent: Jun. 12, 2012

(54) DEVICE AND METHOD OF DISPENSING PRESSURIZED FLUID

(76) Inventor: Josef Krzecki, Milwaukee, WI (US)

( * ) Notice: Subject to any disclaimer, the term of this patent is extended or adjusted under 35 U.S.C. 154(b) by 0 days.

(21) Appl. No.: 13/263,322

(22) PCT Filed: Apr. 30, 2010

(86) PCT No.: PCT/US2010/033093

§ 371 (c)(1),
(2), (4) Date: Oct. 6, 2011

(87) PCT Pub. No.: WO2010/127202

PCT Pub. Date: Nov. 4, 2010

(65) Prior Publication Data

US 2012/0074175 A1 Mar. 29, 2012

Related U.S. Application Data

(60) Provisional application No. 61/174,656, filed on May 1, 2009.

(51) Int. Cl.
*B65D 83/00* (2006.01)

(52) U.S. Cl. ..... 222/394; 222/83.5; 222/402.2; 222/402.25; 222/464.2; 222/509; 222/514; 222/518

(58) Field of Classification Search ..... 222/81–83.5, 222/88, 89, 91, 402.1, 402.13, 402.2, 402.25, 222/464.1–464.3, 505, 507, 509, 511, 513, 222/514, 518, 559, 561, 567, 568, 570; 215/4, 215/5; 141/14, 15

See application file for complete search history.

(56) References Cited

U.S. PATENT DOCUMENTS

| | | | | |
|---|---|---|---|---|
| 1,324,206 | A | 12/1919 | Nickell | |
| 2,184,397 | A | 12/1930 | Nelson | |
| 1,933,192 | A | 10/1933 | Taylor | |
| 2,082,706 | A | 6/1937 | Maggiora | |
| 2,090,977 | A * | 8/1937 | Hoffman | 222/83 |
| 2,091,737 | A | 8/1937 | Longway | |
| 2,246,693 | A | 6/1941 | Ohme | |
| 2,685,978 | A | 7/1952 | Crockett | |
| 2,679,747 | A | 5/1954 | Caitung | |
| 2,726,789 | A | 12/1955 | Perry | |
| 3,424,347 | A | 1/1969 | Trodglen | |
| 4,162,745 | A * | 7/1979 | Anderson, Jr. | 222/148 |
| 4,194,653 | A | 3/1980 | Brown | |

(Continued)

FOREIGN PATENT DOCUMENTS

EP 0 559 924 A1 9/1993

(Continued)

OTHER PUBLICATIONS

Ken Xu, Flat Soda Prevention with Fizz Soda Dispenser, Ken's Gadgets Website, first published online at http://gadgets.kenxu.com/flat-soda-prevention-with-fizz-soda-dispenser/ on Dec. 5, 2008.

*Primary Examiner* — J. Casimer Jacyna
(74) *Attorney, Agent, or Firm* — Cherskov Flaynik & Gurda, LLC

(57) ABSTRACT

Embodiments relate to a device and method for dispensing pressurized fluid from a container wherein the internal pressure of the container is not exposed to an external or ambient atmosphere.

11 Claims, 12 Drawing Sheets

U.S. PATENT DOCUMENTS

| | | | | |
|---|---|---|---|---|
| 4,773,571 | A | 9/1988 | Hagan et al. | |
| 4,778,081 | A | 10/1988 | Vaughan | |
| 4,982,879 | A | 1/1991 | Corrado | |
| 4,995,534 | A | 2/1991 | Norman | |
| 5,022,565 | A * | 6/1991 | Sturman et al. | 222/396 |
| 5,118,009 | A | 6/1992 | Novitsky | |
| 5,240,144 | A * | 8/1993 | Feldman | 222/82 |
| 5,350,090 | A | 9/1994 | McClure | |
| 5,390,832 | A | 2/1995 | Lombardo | |
| D361,242 | S | 8/1995 | Baroudi | |
| 5,501,375 | A * | 3/1996 | Nilson | 222/402.13 |
| 6,454,142 | B1 | 9/2002 | Meynet | |
| 6,540,111 | B2 | 4/2003 | Sunnarborg | |
| 7,114,634 | B2 | 10/2006 | Azodi | |
| 7,367,479 | B2 | 5/2008 | Sitz | |
| 2002/0050496 | A1 * | 5/2002 | Van Der Meer et al. | 222/105 |
| 2008/0078769 | A1 | 4/2008 | Crunkleton, III et al. | |
| 2009/0008357 | A1 | 1/2009 | Azodi et al. | |

FOREIGN PATENT DOCUMENTS

| | | |
|---|---|---|
| GB | 981259 | 1/1965 |

* cited by examiner

Figure 3A-C 166
128
140
142
168
170
172
152
178
150
174
176
160
162
186
188
189
154
190
184
180
182

Figure 9
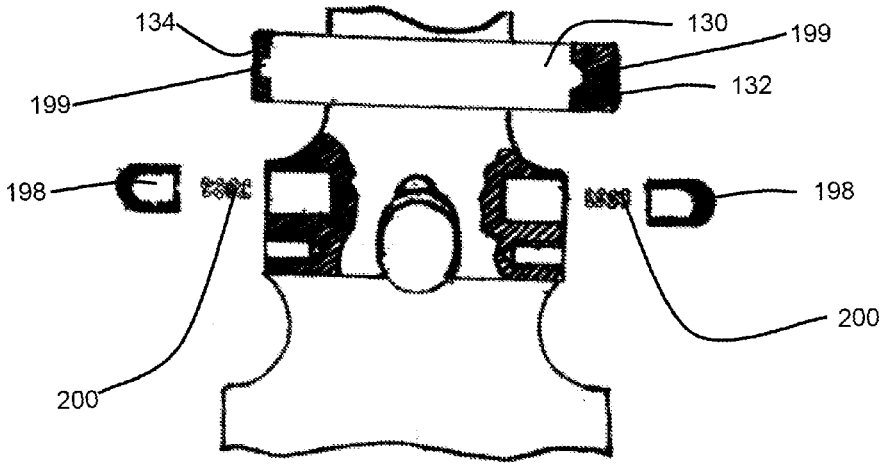
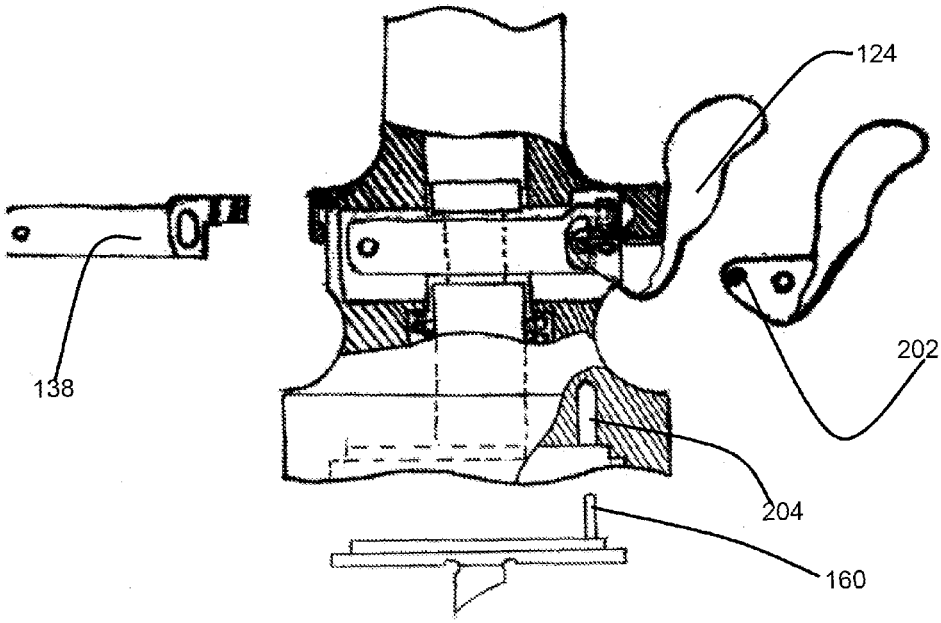

DEVICE AND METHOD OF DISPENSING PRESSURIZED FLUID

CROSS REFERENCE TO RELATED APPLICATIONS

This application claims the benefit as a nationalization of PCT Application PCT/US10/33093, filed on Apr. 30, 2010, currently pending, which turn claims priority to U.S. Provisional Application No. 61/174,656 filed on May 1, 2009.

BACKGROUND OF THE INVENTION

1. Field of the Invention

This invention relates to a device and method for dispensing fluid, and in particular, the invention relates to a device and method for dispending fluid from a pressurized container without exposing the interior of the pressurized container to an outside atmosphere.

2. Background of the Invention

Pressurized fluids, such as soda pop, beer, and $CO_2$ gas, are commonly sold in a variety of containers. Typical pressure range from about 20 psi to 60 psi. Standard pressurized container configurations in the beverage industry include two- and three-liter bottles.

The drawback to these containers is that upon removal of the cap of the container, its entire contents are exposed to the atmosphere. Once the contents of the container are exposed to the ambient atmosphere, the fluid contained therein no longer has the same consistency as it did at the time the fluid was transferred into the container.

An example of a pressurized fluid is beverage soda. Soda may be purchased in single serving containers or as contained within a 2-liter bottle. A container having multiple servings looses much of its carbonation when the bottle is opened, even before the first serving is dispensed. Even if the bottle cap is soon replaced, much of the carbonation is lost. Consequently, as the container is being emptied, the amount of carbonation, and consequently the appeal of the fluid, decreases dramatically. The end result of this process is that the final servings appeal only to those consumers with non-discerning tastes.

The loss of carbonation prevents the use of multiple-serving containers in scenarios where consistency of dispensed product is required or by those users who do not plan to consume the entire contents in a short time frame.

A need exists in the art for a method and device for dispensing fluid from a container of pressurized fluid wherein a single serving may be obtained from the container without exposing the remaining fluid to the ambient environment.

SUMMARY OF THE INVENTION

An object of the invention is to provide a device and method for dispensing fluid from a pressurized container which overcomes many of the disadvantages of the prior art.

It is a further object of the present invention to provide the means to facilitate opening of a container without exposure of the contents to an ambient atmosphere. A feature of the invention is the use of a sealed cap cutter to breach the top cap of a container. An advantage of the invention is that the device can be used to open bottles while maintaining the native fluid pressure of the contents of the bottle.

An additional object of the present invention is to provide a device for dispensing single servings from a container of pressurized fluid. A feature of the invention is that it contains a plunger and valve assembly. An advantage of the invention is that the device is capable of dispensing fluid while hermetically sealing the remaining fluid from the external environment.

A further object of the present invention is to provide a means to remove fluid from a bottle while the bottle remains upright. A feature of the invention is that it utilizes a conduit, in slidable communication with the bottle, for transmittal of pressurized fluid. An advantage of the invention is that the device is capable of emptying pressurized liquid from all interior spaces of the bottle.

Briefly, the invention provides a device for dispensing pressurized fluid from a container defining a neck and a cap, the device comprising: a collar adapted to be removably received by the neck; a housing in threadable communication with said collar; a plunger centrally positioned within said housing, wherein said plunger defines a longitudinally extending channel; a lever for raising and lowering the plunger; a conduit having a first end and a second end, said conduit in slidable communication with said channel, whereby the first end of said conduit is positioned inside the container, and a region of the conduit intermediate said first and second ends define an aperture positioned within the channel; and a fluid passage way defined by a depending surface of said plunger and the cap such that when said lever raises the plunger, fluid communication is established between the inside of the container and the exterior of the container. The invention also provides a method for using internal container pressure to dispense fluid from the container, the method comprising circumscribing an end of the container with a housing containing a valve; puncturing a region of the container enclosed by the housing such that the housing prevents pressure escaping from the container; threading a conduit (having a first open end, a closed second end, and an intermediate region defining an aperture), through the housing so that the open end resides inside the container; and manipulating the valve so as to force the fluid through the aperture to the outside of the collar.

DESCRIPTION OF THE DRAWING

Embodiments together with the above and other objects and advantages may best be understood from the following detailed description of the embodiments illustrated in the drawings, wherein:

FIGS. 9 and 9B depict a partially exploded view of an embodiment of a device for dispensing of pressurized fluid, in accordance with features of the present invention;

DETAILED DESCRIPTION OF THE INVENTION

Figure 1:
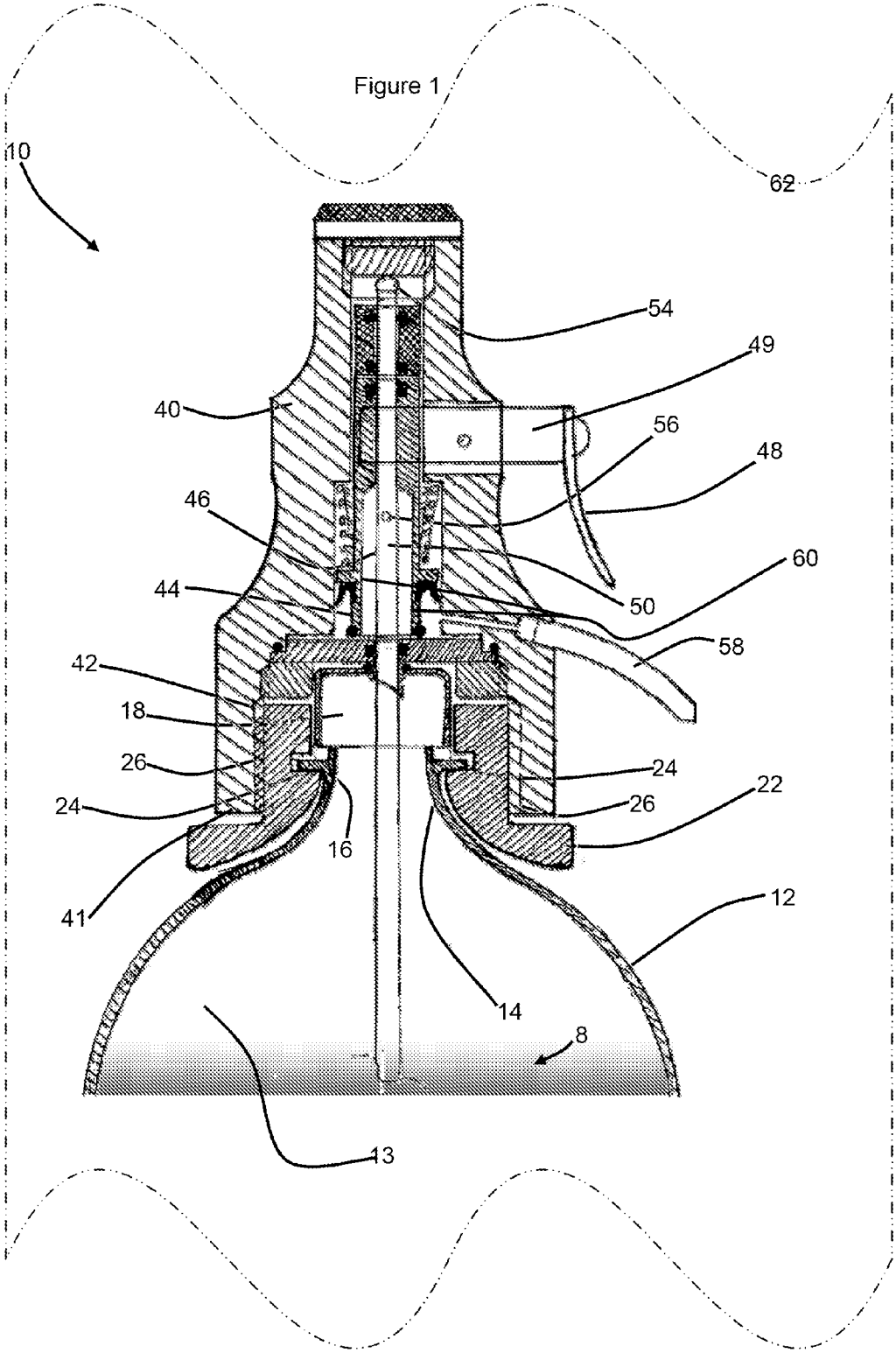
FIG. 1 depicts a cut-away view of an embodiment of the device mounted to a beverage bottle, in accordance with features of the present invention.

Turning first to FIG. 1, depicted there is an elevational cut-away view of one embodiment of the instant invention. The invention comprises a generally elongated device 10 for dispensing pressurized fluid 8 from an interior space 13 of a bottle or container 12. The device 10 is adapted to be received by the container 12 wherein the container 12 features a neck 14 defining a radially projecting ridge 16. The interior space 13 of the container 12 is hermetically sealed from an atmosphere 62 external to the container 12 inasmuch as the neck 14 of the container 12 terminates in a sealed cap 18. The external atmosphere 62 surrounds the container 12 and is designated on FIG. 1 as an irregular dashed line surrounding the bottle. The fluid 8 contained by the container 12 is considered to be pressurized in that it is at a higher relative pressure than the surrounding atmosphere 62. Examples of containers of pressurized fluid include a standard two-liter bottle of soda, a standard three-liter bottle of soda, a beer keg, and the like. In other embodiments, the device 10 provides additional means of removable attachment to kegs, cans, and other containers, not having a neck and associated neck ridge.

In one embodiment, the device 10 comprises a collar 22 and a housing 40. A distal or superior end of the housing terminates in a longitudinally-, axially-extending cavity 41. The collar 22 and the housing 40 are removably applied to the container 12 in separate steps. The collar 22 serves as an anchor to which the housing attaches along the collar's periphery. The collar 22, in one embodiment, features an opening to allow slidable installation on the bottle 12, therefore, the collar features a 'u-shaped' design.

The collar 22 defines an annular groove 24 adapted to receive the container's 12 ridge 16. The annular groove 24 contacts the container neck ridge 16 along substantially the circumferential periphery of the ridge 16. The collar 22 remains in place upon mating with the neck ridge 16. A peripheral, circumferentially-extending region of the collar 22 defines collar threads 26 which mate with a medially-directed surface of the housing 40 forming a frusto-conical cavity.

The second component of one embodiment of the invention is the housing 40. The housing 40 is designed to be removably received by the collar threads 26. As noted supra, an interior surface of the housing 40 defines threads 42. The threaded surface of the housing has a greater breadth than the region defining the threaded periphery of the collar. This allows the depending end 41 of the housing to extend beyond the collar.

A region of the housing 40 distal to its threaded end defines a longitudinally, distally-extending channel 46. Slidably communicating with the longitudinally extending channel 46 is a conduit 50. The conduit includes a first end (not shown in FIG. 1) and a second end 54. The second end 54 is unopened, in one embodiment and while first end is open. A region of the conduit disposed near its second end 54 defines an aperture 56. The aperture 56 is positioned along the conduit 50 such that upon positioning of the conduit 50 into the channel 46, second closed end 54 of the conduit 50 is located within a superior region of the channel 46, and the aperture 56 is open into an area of the by channel residing at a midpoint within the housing coaxially positioned within the channel in a plunger 44. The plunger 44 is in slidable communication with the channel. The plunger is rigidly mounted to a generally perpendicular arm 49 which is radially directed from the longitudinal axis of the plunger 44. A midpoint of the arm 49 is pivotally mounted to the housing and terminates in a finger-pushed lever 48. A force applied to a lever 48 results in upward movement of the plunger 44.

As shown in FIG. 1, the conduit 50 first end extends into the bottle or container 12 wherein said bottle contains pressurized fluid 8. When the cap is pierced, the pressurized fluid 8 travels through the conduit 50 and fills the area defined by the channel walls 60. The fluid 8 remains encapsulated within the area defined by channels walls 60 until the plunger 44 is actuated upwardly so as to allow the pressurized fluid 8 to move beyond the area defined by channel walls 60, through the fluid passageway 58. Upon lifting of the plunger 44 through operation of the lever 48, the fluid 8 contained by the chamber defined by channel walls 60 will exit toward the low pressure atmosphere 62 environment through the fluid passageway 58.

Figure 2:
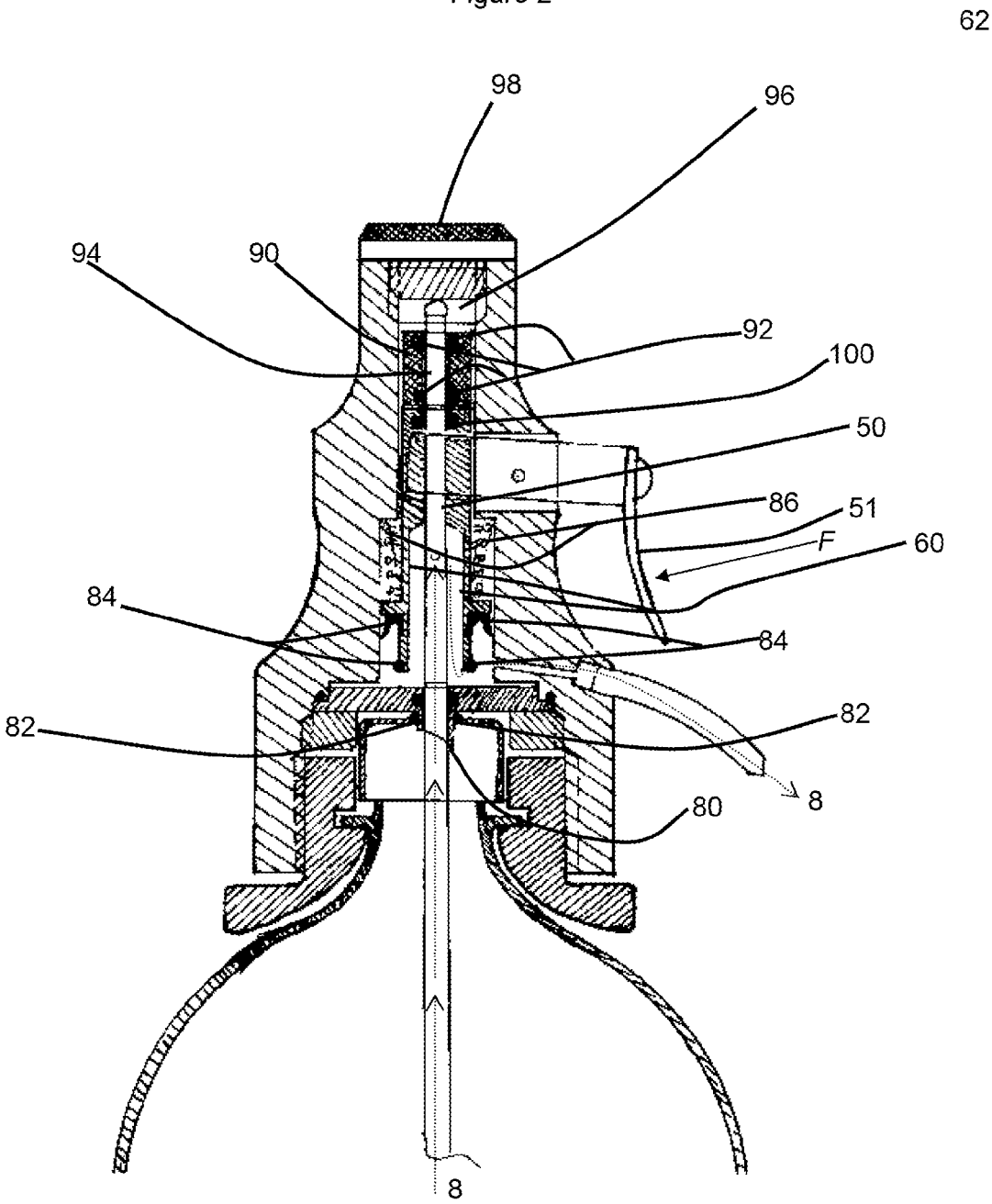
FIG. 2 depicts another cut-away view of an embodiment of the device mounted to a beverage bottle, in accordance with features of the present invention.

Further details of one embodiment of the invention are shown in FIG. 2. As shown in FIG. 2, lever 48 is actuated, with the arrows depicting subsequent fluid flow.

As the housing 40 is mounted onto the corresponding collar, a cutter 80 breaches the top surface of the cap 18. In one embodiment, the cutter 80 is a reinforced sharpened plastic cutter wherein the angle of cutter 80 cutting surface is between 20 to 90 degrees. The breaching of the surface does not result in exposure of the contents of the bottle to the external environment. This is due to the cutter 80, axially positioned within the housing, being surrounded by cap seals 82. In one embodiment, the cap seals 82 are o-rings. Consequently, the cap seals 82 form a seal around the cutter 80.

Upon breaching of the cap 18 with the cutter 80, the opening in the cap 18 established between the interior of the container and the chamber formed by the channel walls 60. Inasmuch as the plunger 44 is in a downward or closed position, the chamber is not exposed to any external atmosphere.

The plunger 44 contains at least one seal 84 mounted about the periphery of the plunger. In one embodiment, one of the plunger seals is a cup seal wherein the cup seal prevents fluid flow at the bottom of the plunger. The cup seal is surrounded by o-ring seals. Consequently, the plunger 44 maintains a seal between the environment within the chamber formed by the channel walls 60 and the external atmosphere 62.

Upon medially directed movement (Force F in FIG. 2) of the finger-pull surface 51, the plunger 44 opens the chamber formed by the walls 60 to an external atmosphere 62. In order to maintain the plunger in an upward position, force must be continuously applied to the surface 51. Otherwise, the plunger 44 will descend back into a closed position due to the downward force applied by an opposing spring 86.

A superior region of the longitudinally extending channel 46 restricted down to the outside diameter (OD) of the conduit, and circumferentially lined with a seal 100. This channel seal 100 prevents fluid or gas exchanges between the exterior of the conduit 50 and the longitudinally extending channel 46.

Prior to the cutting of the cap 18 with the cutter 80, the conduit 50 is positioned so that its first end is above the cutter 80. At this point, the conduit 50 is open to the external atmosphere 62 due to the aperture 56 remaining outside of the housing 40. However, this aperture 56 is removably sealed with a sleeve 90 in slidable communication with the outside surface of the conduit. In one embodiment, the sealing means 90 is a bushing. The bushing 90 includes bushing seals 92 wherein the seals prevent an exchange of gas between the interior of the bushing 90 and an external atmosphere.

Upon breaching of the cap 18 by the cutter 80, the pressurized fluid can only move into the conduit 50 due to the bushing seals 92, the cap seals 82, and the plunger seals 84. Consequently, the separation between the interior of the bottle and an external atmosphere is maintained. Once the cap 18 is opened, the conduit 50 extends through the cutter 80 into the bottle or container 12. As the conduit 50 moves downwardly, the sealing means 90 moves with the conduit 50 so as to maintain closure over the aperture 56. The bushing is finally received by the bushing channel 94. As the bushing 90 enters the channel 94, the bushing 90 can no longer move in concert with the conduit 50. Instead, the bushing 94 remains stationary while the conduit continues to move into the longitudinally extending channel 46. While the aperture 56 leaves the confines of the bushing, it is not exposed to the external atmosphere 62 inasmuch as the bushing seals 92 are in physical communication with channel seals 100. Consequently, as the aperture 56 passes over the two seals 92, 100, it is not open to the external atmosphere 62.

Upon passage of the second sealed end 54 into the bushing channel 94, a conduit cap 96 is removably attached to the superior, or distal end of the longitudinally extending channel. The conduit cap 96 may contain an integral housing cap 98 which covers the open end of the housing. In other embodiments, the housing cap 98 is a separate cover.

Figure 3:
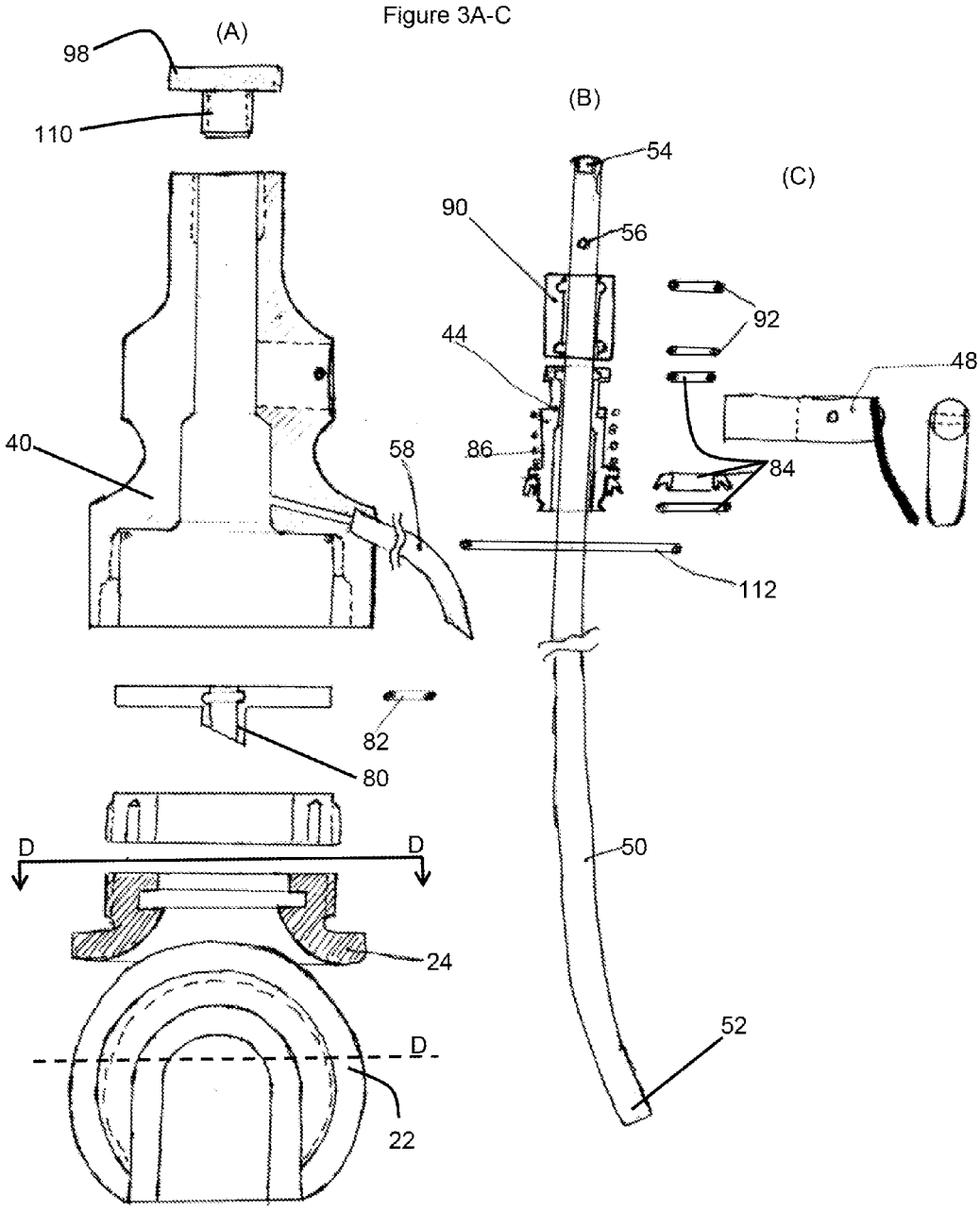
FIGS. 3A-C depict a partially exploded view of an embodiment of a device for dispensing of pressurized fluid, in accordance with features of the present invention.

FIG. 3(A) shows a detailed view of the housing cap 98. The housing cap contains one or more threads 110 so at to be threadably received by the cavity 41. As shown in the embodiment found in FIG. 3(A), the cutter 80 defines a separate assembly received into a proximal channel.

FIG. 3(B) shows a detailed view of the conduit 50, including the first open end 52. Additional housing seals 112 are disposed around the conduit 50 in some embodiments of the invention. Further details of one embodiment shown in FIG. 3(B) include the springs 86, the plunger 44, the bushing 90 and the aperture 56. Finally, the conduit 50 is shown as having a second closed end 54.

FIG. 3(C) is designed to show the details of the seals used by one embodiment of the instant invention. There are bushing seals 92 and a set of plunger seals 84. FIG. 3(C) also shows the lever 48 used to move the plunger 44.

Figure 4:
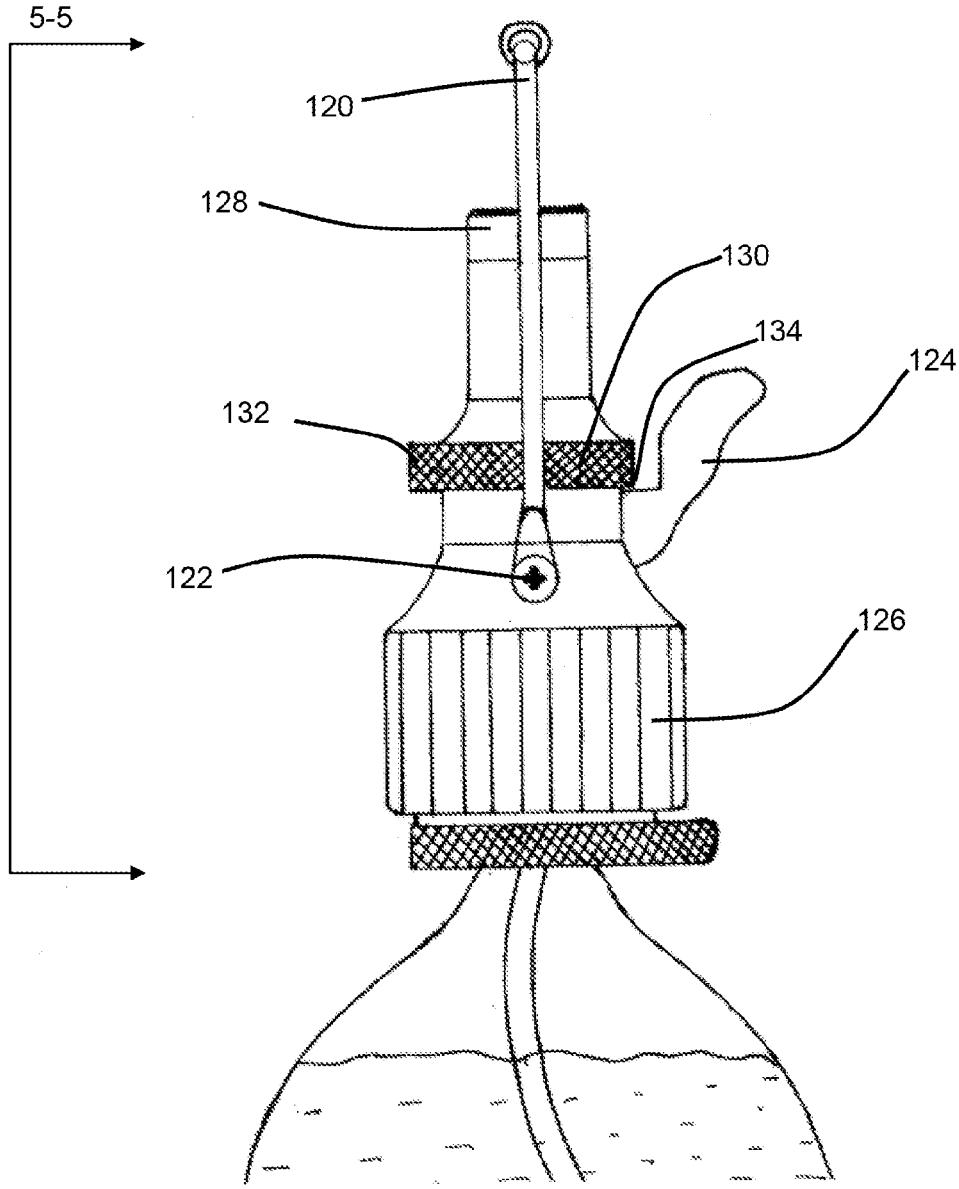
FIG. 4 is a side view of an embodiment of the device mounted to a beverage bottle, in accordance with features of the present invention.

Another embodiment of the invention is depicted in FIG. 4. As shown therein, the embodiment includes a handle 120 attached to the device at handle mounting points 122. The embodiment shown in FIG. 4 includes an upward lever 124. As further described herein in conjunction with FIG. 9, he upward lever 124 interacts with a stopper 130. In the embodiment shown in FIG. 4, the stopper 130 is a substantially circular shape having a first side 132 that is wider or contains additional material than a second side 134. The device also includes an integral housing cover 128 disposed on top of the main body of the device.

The embodiment shown in FIG. 4 further includes a series of groves 126 incorporated into the housing of the device.

Figure 5:
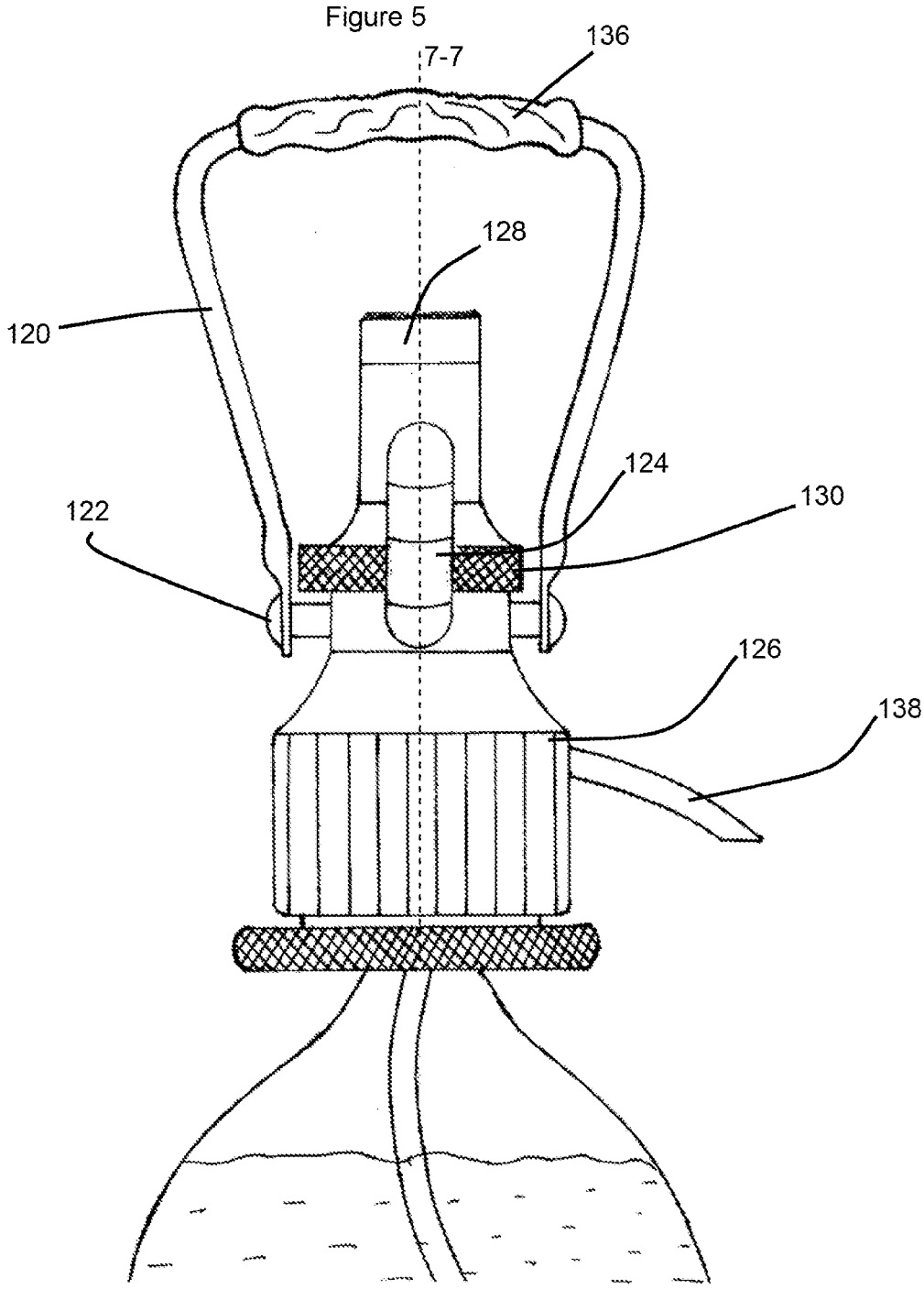
FIG. 5 is another side view of an embodiment of the device mounted to a beverage bottle, in accordance with features of the present invention.

The embodiment of the invention shown in FIG. 4 is depicted from another angle in FIG. 5. As shown in FIG. 5, the handle 120 includes a handle hand receiver 136. The handle hand receiver 136 is included so that the handle 120 may be gripped without the material of the handle contacting the carrier's hand. As extended, the hand receiver 136 is sufficiently separated from the integral housing cover 128 so that an adult hand may fit in the space between these two components. In one embodiment, this space is 3½ inches. Further, as is shown in FIG. 5, the handle mounting points 122 result in the handle 120 extending sufficiently away from the device such that the handle does not interfere with the movement of the stopper 130. Finally, the handle 120 is designed to not contact either the spout 138 or the upward lever 124 during pivoting of said handle 120 around handle mounting points 122.

Figure 6:
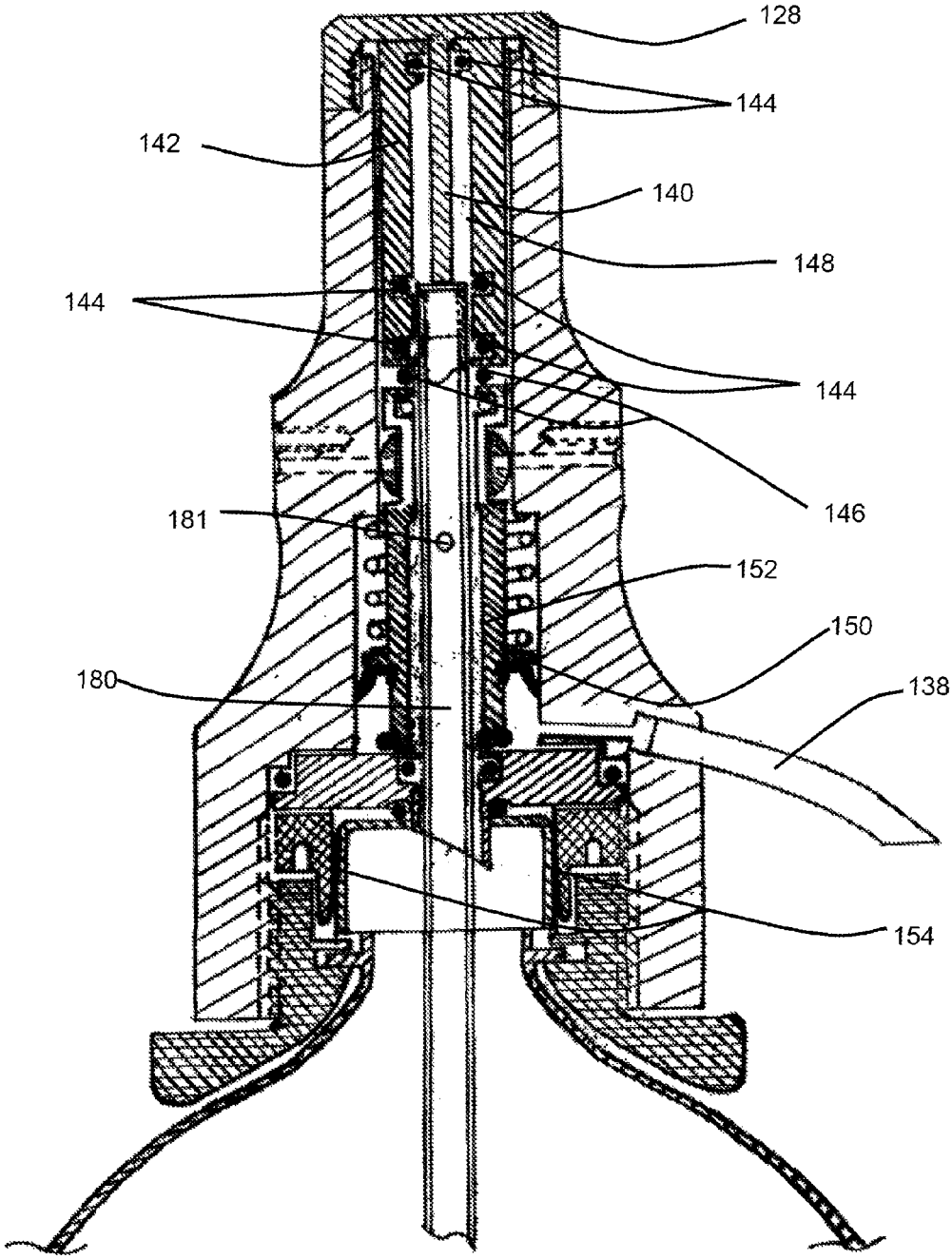
FIG. 6 depicts a cut-away view of an embodiment of the device mounted to a beverage bottle, in accordance with features of the present invention.

A cross-section of an embodiment of the invention is shown in FIG. 6. As depicted in FIG. 6, the embodiment includes a integral housing cover 128 wherein the integral housing cover 128 includes a cover pusher appendage 140 extending from the inside of the housing cover 128. Upon closing of the housing cover 128, the pusher appendage 140 forces the flexible conduit 180 into a loaded position. The flexible conduit 180 is considered to be in the loaded position when the conduit aperture is within the boundary of the main chamber 152.

The embodiment further incorporates a cover bushing 142. Said cover bushing receives the pusher appendage 140 and includes an enclosure 148 to receive the flexible conduit 180. The cover bushing enclosure 148 is defined by interior of cover bushing 142 and cover bushing seals 144 located at either end of said enclosure 148. One end of cover bushing 142 rests against integral housing cover 128 while cover bushing 142 opposite end terminates in cover bushing receiving seals 146. The size of the cover bushing 142 enclosure 148 is approximately the same as the size of the main chamber 152. Upon opening of the device, the main chamber 152 is in fluid communication with the interior of the spout 138.

As shown in FIG. 6, the main chamber is defined by a plunger 150 and cover bushing receiving seals 146. The embodiment shown in FIG. 5 further includes a bottle cap holder 154 designed to prevent lateral movement of the bottle on which the device is mounted on.

Figure 7:
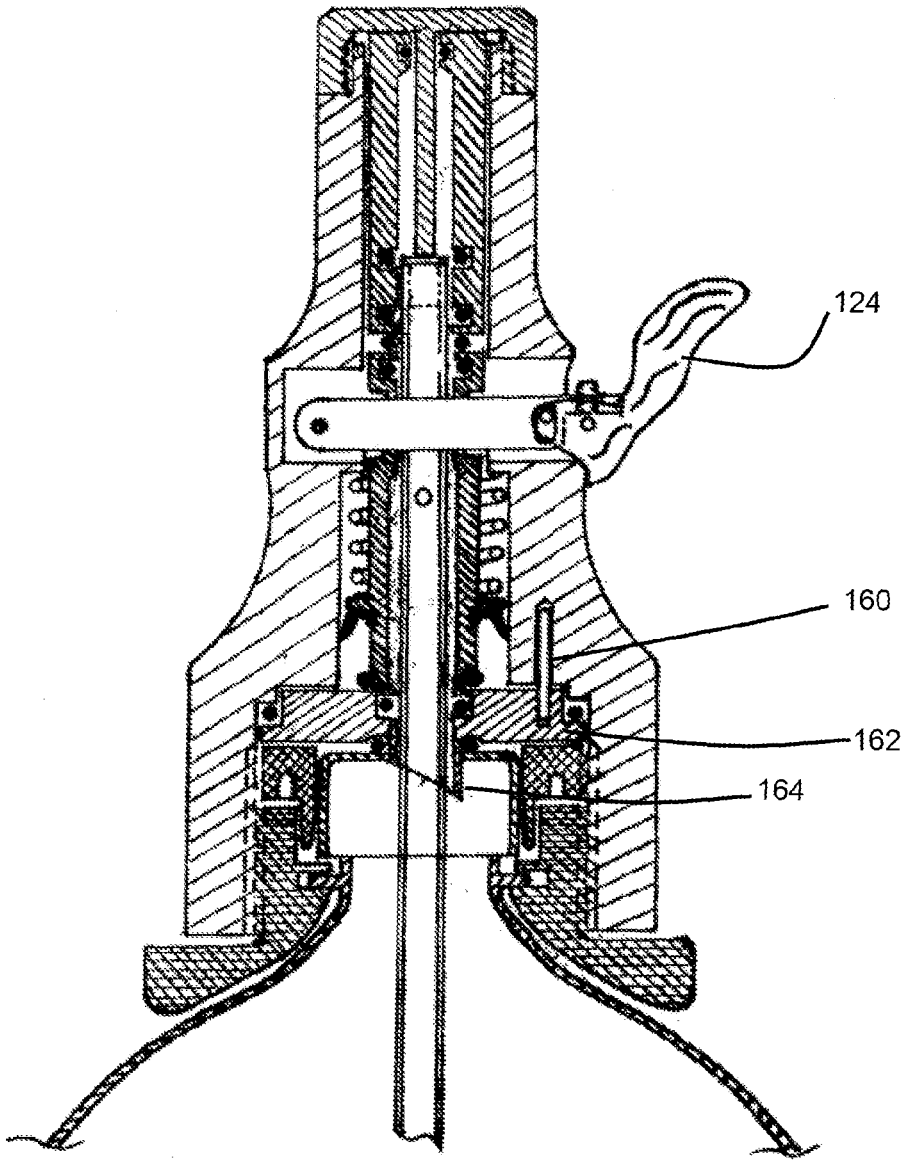
FIG. 7 depicts a cut-away view of an embodiment of the device mounted to a beverage bottle, in accordance with features of the present invention.

Turning now to FIG. 7, depicted therein is the upward lever 124. Further visible in FIG. 7 is the lockout pin 160. The lockout pin 160 extends into a cap cutter base 162. In turn a cap cutter 164 extends from the cap cutter base 162. The lockout pin 160 and the cap cutter 164 extend in opposite directions from the plane formed by the cap cutter base 162.

Figures 8A, 8B:
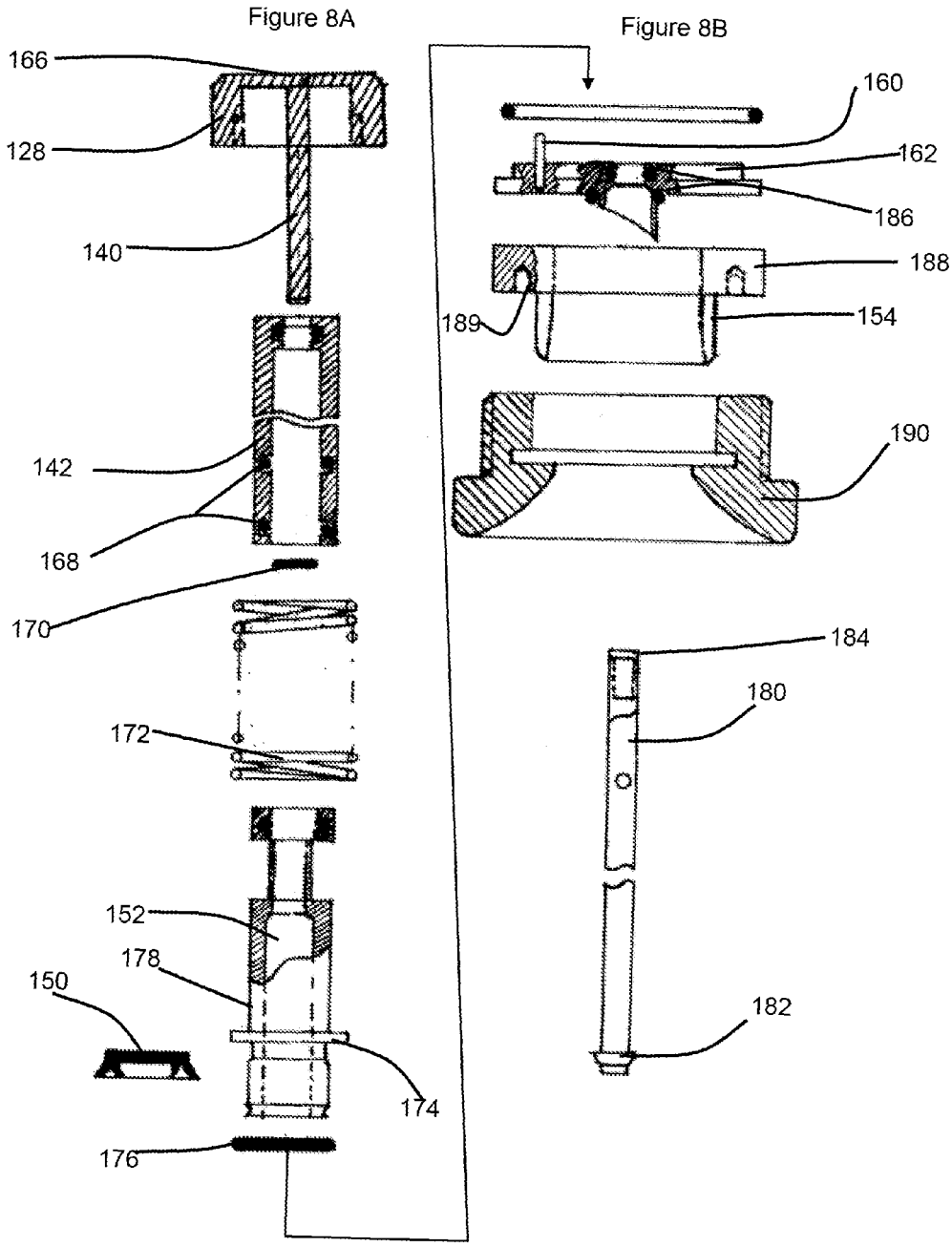
FIGS. 8A-B depict a partially exploded view of an embodiment of a device for dispensing of pressurized fluid, in accordance with features of the present invention.

FIG. 8A depicts the details of the interaction of the housing cover 128 with the remaining elements of one embodiment of the device in an exploded view. The housing cover 128 incorporates a top surface 166 and a cover pusher appendage 140. The cover pusher appendage 140 extends away from the top surface 166. The cover pusher appendage 140 is removably received by the cover bushing 142 wherein the cover bushing incorporates two bushing groves 168. The bushing groves 168 receive seals such that the interior surface of the cap bushing 142 may be removably sealed off from an external atmosphere. In order to ensure a seal, the cap bushing 142 includes a bushing ring seal 170. A spring 172 is received beneath the cap bushing 142.

In the embodiment shown in FIG. 8A, the spring 172 surrounds the main housing 152. The spring is received by the main housing exterior surface 178. The spring rests against a main plunger surface 174. Spring 172 rests against one side of the plunger surface 174, while the plunger 150 rests against the opposing side. In turn, the main housing incorporates a seal 176.

FIG. 8B depicts the elements of one embodiment of the invention starting with the main housing support plane on which the main housing seal 176 is placed. Said support plane includes a notch, not shown, to receive the lockout pin 160 of the cap cutter base 162. The cap cutter base 162 includes two cap cutter seals 186. The cap cutter seals 186 form a seal between the cap cutter base 162 and a cap holder base 188. The cap holder base 188 incorporates two notches 189 which allow for assembly of the cap holder base 188 and the cap cutter base 162. As fully assembled, the bottle cap holder base 188 is incorporated into a housing, not shown. The housing is in turn removably received on top of the bottle collar 190.

As shown in FIG. 8B, the flexible conduit 180 incorporates two ends. One end is closed with a conduit stopper 184. The opposite end incorporates a conduit ring 182.

Figure 9B:
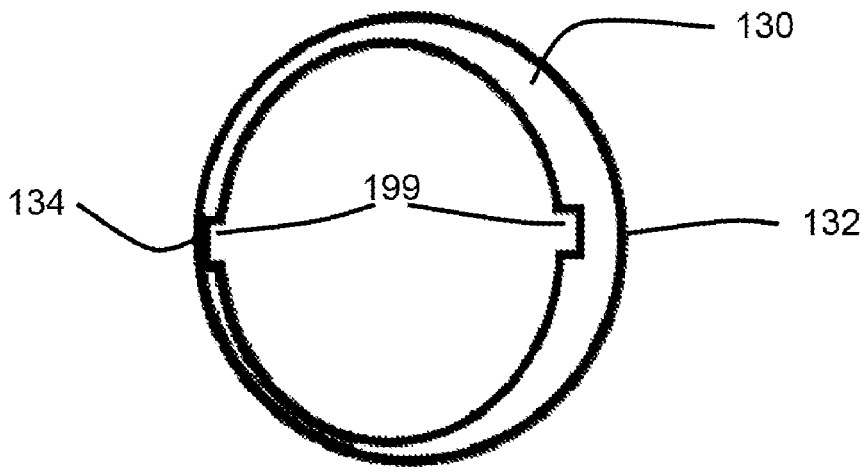

FIGS. 9 and 9B depict the details of the stopper 130 interaction with the upward lever 124. The stopper 130 features a substantially round inner surface. Said inner surface includes grooves 199 for receiving stopper lock bolts 198. The stopper lock bolts 198, upon extending into stopper 130 grooves 199 prevent movement of the stopper 130 until additional force is applied. The lock bolts 198 are extended outwardly by springs 200. Stopper 130 grooves 199 are present at two distinct locations along the inner diameter of the stopper 130. First, one groove 199 is located at stopper first side 132. Stopper first side 132 is wider than stopper second side 134. Stopper 130 second side 134 also incorporates a groove 199.

Due to the interaction between the lock bolts 198 and the grooves 199, the stopper 130 may move in any location, however in two locations the stopper 130 locks in place.

As shown in FIG. 9, when the wider first end 132 is locked in place in proximity to the upward lever 124, the upward lever 124 is locked in place and cannot pivot on its pivot point 202. Consequently, during contact of first end 132 with upward lever 124, upward lever 124 cannot be articulated such that fluid will flow from spout 138.

FIG. 9 also shows the cutter lockout pin receiving aperture as defined by one embodiment of the invention.

Figure 10:
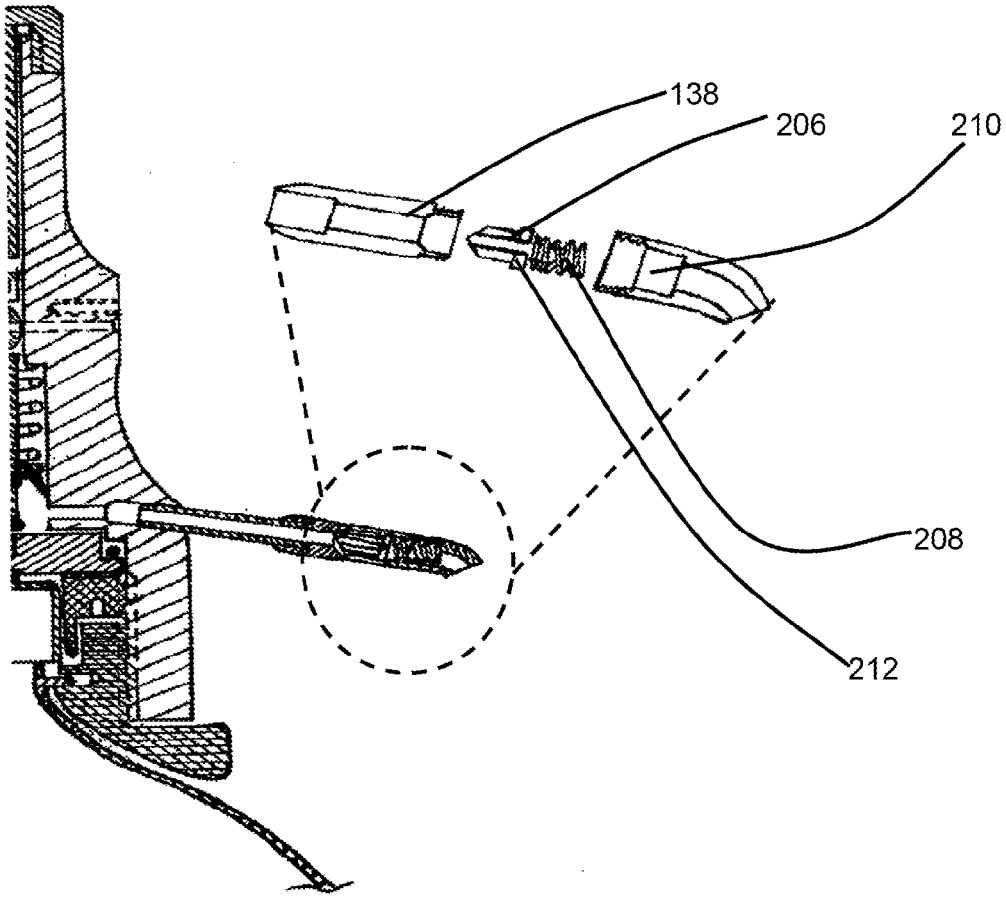
FIG. 10 depicts a partially exploded view of an embodiment of a device for dispensing of pressurized fluid, in accordance with features of the present invention.

Turning now to FIG. 10, shown therein are the details of a spout plug 206. Spout plug 206 is incorporated into the spout to prevent dripping at the conclusion of the dispensing cycle. Spout plug is received by a receiving aperture 210. The plug consists of a closing ring 212 and a spring 208. During flow of pressurized fluid, the fluid pushes against the ring 212 and against force of spring 208. Upon the conclusion of flow of fluid, spring 208 moves the ring 206 up and closes the spout 138. The plug 206 is received by the spout 138 in a removable segment defined by threading shown in FIG. 10.

Figure 11:
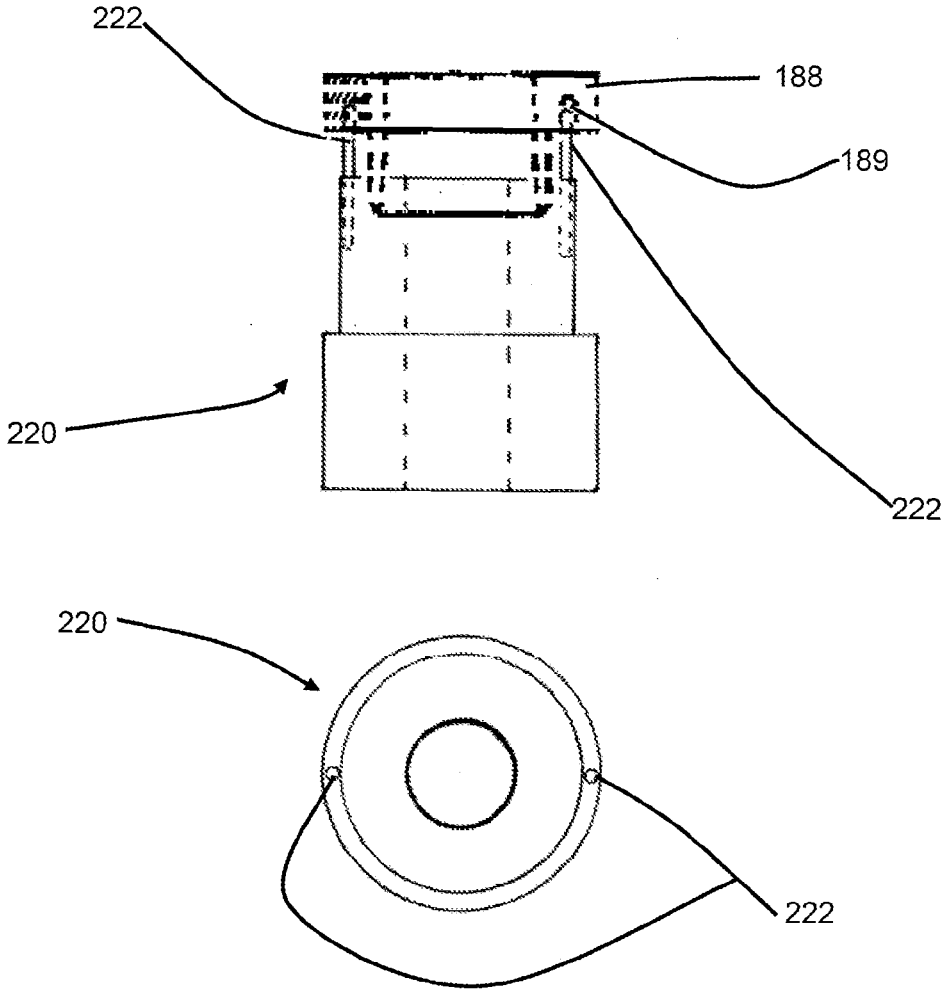
FIG. 11 depicts a mounting tool, in accordance with features of the present invention.

Finally, turning to FIG. 11, depicted therein is an assembly tool 220. The assembly tool is designed to allow for combination of the bottle cap holder base 188, as shown in FIG. 8B with the housing and other elements. As visible in FIG. 8A, the bottle cap holder 154 incorporates notches 189. The assembly tool 220 prongs 222 are spaced such that they are removably received by the notches. Radial movement of the assembly tool 220 allows for placement of the bottle cap holder base 188 within the device housing. Further, should the need arise, the assembly tool facilitates the removal of the base 188 from the housing.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The embodiment of the invention in which an exclusive property or privilege is claimed is defined as follows:

1. A device for dispensing pressurized fluid from a container defining a neck and a cap, the device comprising:

a) a collar adapted to be removably received by the neck;

b) a housing in threadable communication with said collar;

c) a plunger centrally positioned within said housing, wherein said plunger defines a longitudinally extending channel;

d) a lever for raising and lowering the plunger;

e) a conduit having a first end and a second end, said conduit in slidable communication with said channel, whereby the first end of said conduit is positioned inside the container, and a region of the conduit intermediate said first and second ends define an aperture positioned within the channel; and f) a fluid passage way defined by a depending surface of said plunger and the cap such that when said lever raises the plunger, fluid communication is established between the inside of the container and the exterior of the container.

2. The device of claim 1 wherein a depending surface of the housing defines a means for puncturing the cap.

3. The device of claim 1 wherein the second end of the conduit is sealed.

4. The device of claim 3 wherein said aperture is in proximity to the second sealed end.

5. The device of claim 1 further comprising a means for removably sealing said aperture.

6. The device of claim 1 wherein the housing and the threaded collar are received by the container without removal of the container cap.

7. The device of claim 6 wherein the housing and the threaded collar are received by the container without exposure of the container contents to ambient atmosphere.

8. The device of claim 1 wherein the container is maintained at an upright position during dispensing of fluid.

9. The device of claim 1 wherein the plunger is spring biased in a lower-most position to prevent fluid communications between the insider of the container and the exterior of the container.

10. The device of claim 1 wherein the container dispenses the pressurized fluid from the container using only internal container pressure.

11. The device of claim 1 where in the conduit is a reversibly deformable conduit.

* * * * *